US010619466B2

(12) United States Patent
Mills et al.

(10) Patent No.: US 10,619,466 B2
(45) Date of Patent: Apr. 14, 2020

(54) DEPLOYING MINERAL INSULATED CABLE DOWN-HOLE

(71) Applicant: ConocoPhillips Company, Houston, TX (US)

(72) Inventors: James A. Mills, Houston, TX (US); Daniel J. Eck, Anchorage, AK (US)

(73) Assignee: ConocoPhillips Company, Houston, TX (US)

( * ) Notice: Subject to any disclaimer, the term of this patent is extended or adjusted under 35 U.S.C. 154(b) by 273 days.

(21) Appl. No.: 15/486,423

(22) Filed: Apr. 13, 2017

(65) Prior Publication Data

US 2017/0298718 A1 Oct. 19, 2017

Related U.S. Application Data

(60) Provisional application No. 62/322,607, filed on Apr. 14, 2016.

(51) Int. Cl.

| | |
|---|---|
| ***E21B 43/24*** | (2006.01) |
| ***E21B 23/08*** | (2006.01) |
| ***E21B 23/10*** | (2006.01) |
| ***E21B 23/14*** | (2006.01) |
| ***H05B 3/56*** | (2006.01) |
| ***E21B 33/072*** | (2006.01) |

(52) U.S. Cl.

CPC ..... *E21B 43/2401* (2013.01); *E21B 23/08* (2013.01); *E21B 23/10* (2013.01); *E21B 23/14* (2013.01); *H05B 3/56* (2013.01); *E21B 33/072* (2013.01); *H05B 2203/021* (2013.01); *H05B 2214/03* (2013.01)

(58) Field of Classification Search

CPC ..... E21B 43/2401; E21B 23/08; E21B 23/14; E21B 23/10; E21B 33/072; H05B 3/56; H05B 2214/03; H05B 2203/021

See application file for complete search history.

(56) References Cited

U.S. PATENT DOCUMENTS

| | | | | |
|---|---|---|---|---|
| 1,383,777 A * | 7/1921 | Stephens | E21B 36/04 166/62 |
| 3,547,406 A * | 12/1970 | Fowler | E21B 23/08 254/134.4 |
| 4,125,162 A * | 11/1978 | Groves, Sr. | E21B 19/22 166/368 |
| 4,697,641 A | 10/1987 | White | |

(Continued)

OTHER PUBLICATIONS

Sandberg, et al—"Advances in Electrical Heating Technology for Heavy Oil Production", 2014, SPE International, Presented at the SPE Heavy Oil Conference—Canada, held in Alberta, Canada Jun. 10-12, 2014. SPE-170146-MS, pp. 1-6; 6 pgs.

(Continued)

*Primary Examiner* — Cathleen R Hutchins
*Assistant Examiner* — Jonathan Malikasim
(74) *Attorney, Agent, or Firm* — Boulware & Valoir

(57) ABSTRACT

Methods, system and devices for deploying an MI cable heater down-hole into a hydrocarbon reservoir are provided, wherein one or more MI cables are housed inside a protective jacket, and connected to a pump-in device. The pump-in device allows the cable to be deployed by pumping fluid down-hole, and the pump-in device catches the fluid and pulls the cable down-hole, even in a horizontal well.

16 Claims, 8 Drawing Sheets

(56) References Cited

U.S. PATENT DOCUMENTS

| | | | | |
|---|---|---|---|---|
| 5,871,052 | A | 2/1999 | Benson et al. | |
| 6,009,940 | A | 1/2000 | Eck et al. | |
| 7,322,415 | B2 * | 1/2008 | de St. Remey | E21B 36/04 166/302 |
| 7,322,421 | B2 * | 1/2008 | Blacklaw | E21B 23/08 166/383 |
| 7,568,526 | B2 | 8/2009 | De St. Remey et al. | |
| 8,224,164 | B2 | 7/2012 | Sandberg et al. | |
| 8,459,611 | B2 * | 6/2013 | Allen | H02G 1/086 254/134.3 R |
| 9,347,302 | B2 * | 5/2016 | Kaminsky | E21B 36/04 |
| 9,828,819 | B2 * | 11/2017 | Bujold | E21B 47/01 |
| 2006/0153508 | A1 * | 7/2006 | Bowker | E21B 23/08 385/100 |
| 2011/0017510 | A1 | 1/2011 | Emerson | |
| 2011/0079401 | A1 * | 4/2011 | Gambier | E21B 23/08 166/384 |
| 2016/0333680 | A1 * | 11/2016 | Richter | E21B 43/26 |

OTHER PUBLICATIONS

Ojeda, Samuel S., et al, "Use of Electric Down-hole Heaters to Improve Production and Recovery of Heavy, Viscous Oil in California and Venezuela", 2013, SPE International, Presented at the SPE Kuwait Oil and Gas Show and Conference held in Kuwait Oct. 7-10, 2013, pp. 1-10; 10 pgs.

* cited by examiner

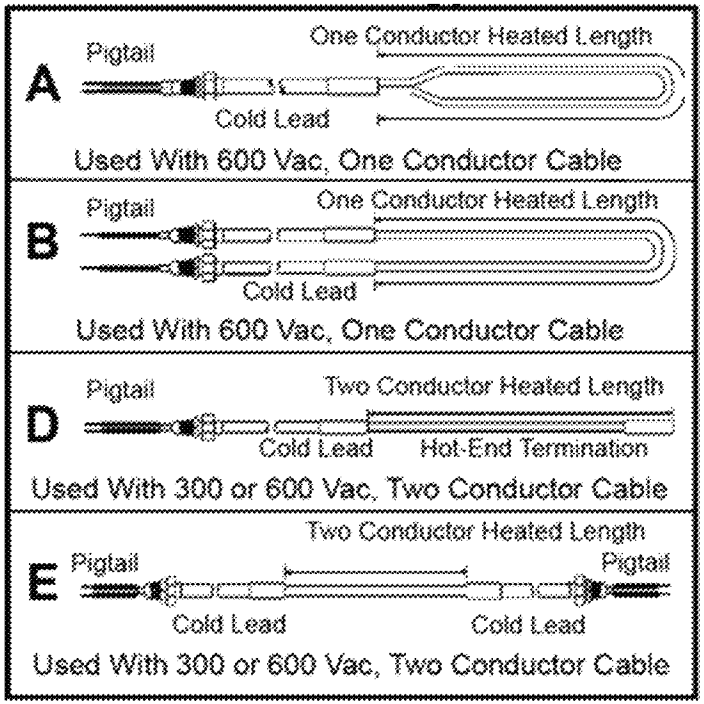
FIGS. 7A-E
(PRIOR ART)

DEPLOYING MINERAL INSULATED CABLE DOWN-HOLE

PRIOR RELATED APPLICATIONS

This application is a non-provisional application which claims benefit under 35 USC § 119(e) to U.S. Provisional Application Ser. No. 62/322,607 filed Apr. 14, 2016, entitled "DEPLOYING MINERAL INSULATED CABLE DOWN-HOLE," which is incorporated herein in its entirety.

FEDERALLY SPONSORED RESEARCH STATEMENT

Not applicable.

FIELD OF THE DISCLOSURE

The disclosure generally relates to methods of deploying mineral insulated heater cable into hydrocarbon wells.

BACKGROUND OF THE DISCLOSURE

The Arctic is estimated to hold the world's largest remaining untapped gas reserves and some of its largest undeveloped oil reserves. These reserves, if tapped, may provide a local energy source for North America. However, the Arctic presents harsh physical conditions that make the production of oil in this environment particularly challenging, including extreme remoteness, ice, extreme low temperatures, and in winter long periods of darkness.

Other cold region deposits include the Athabasca oil sands in Northern Alberta with some 1.7 trillion bbls of bitumen in place—comparable in magnitude to the world's total proven reserves of conventional petroleum. However, the bitumen is too viscous to be produced in this cold environment, and must be heated and/or diluted with solvent before it will flow enough to be produced. The extreme cold temperatures and permafrost in Alaska and Canada contribute significantly to the cost and difficulty in the economical production of these reserves.

For example, one of the major costs involved in producing heavy oil in frigid areas is the cost of maintaining suitable temperature within the production tubing so that the production fluids can readily flow and be pumped to the surface. This is especially vital for that portion of the production tubing that passes through the permafrost. If the temperature within the tubing drops too much, especially during low flow or no flow (i.e. shut-in) conditions, the well fluids cool off and can become too viscous to flow or to be pumped through the tubing. In some cases, the oil can freeze solid within the tubing thereby creating a myriad of problems when the well is returned to full flow production.

Some of the common approaches used to address this problem include insulating the production tubing and/or the wellbore. Indeed, ConocoPhillips has invested significantly in well completions using vacuum insulated tubing, particularly in the vertical portions of steam assisted gravity drainage (SAGD) well pairs, where heat loss significantly increases steam costs.

Another solution is to displace the well fluids from the production tubing back into the wellbore and/or production formation with a non-freezing or anti-freeze fluid additive (e.g. methanol, diesel, or natural gas) during no-flow conditions.

Yet another solution is to strap an electrical, heat trace to the outside of the production tubing, thus heating the tubing to maintain its temperature.

Unfortunately, while each of these techniques may be applicable to particular situations, each may have serious drawbacks in others. For example, insulating the production tubing and/or the wellbore does not prevent freezing of the well fluids in the tubing, but only slows down the process. As to displacing the well fluids back out of the production tubing while production is shut-in, this process is normally expensive and labor intensive in that it must be carried out manually and can not be easily automated to "kick-in" only when needed. Finally, strapping the heat trace to the outside of the production tubing is grossly inefficient due to the amount of heat which is lost directly to the surrounding annulus in the wellbore and is unavailable for heating the inside of the production tubing. Thus, a large portion of the heat generated by an externally-mounted heat trace is immediately lost in the well annulus and is never conveyed to the inside of the production tubing where it needed.

Accordingly, it can be seen that a need continues to exist to automatically maintain the temperature inside the production tubing of a well that extends through a permafrost layer or other cold region at a desired temperature, which allows ready flow of produced fluids therethrough, especially during or after low- or no flow production rates.

U.S. Pat. No. 6,009,940 describes one possible solution, wherein a heating element is lowered down the production tubing and extends through at least the permafrost layer. Preferably, the heating element is a heat trace which is comprised of a commercially-available, electrical power cable of the type commonly used to supply electrical power to down-hole submersible, electrical well pumps. The lower ends of the leads within the cable are connected together to "short-circuit" the cable thereby converting the cable into an elongated, heating element.

A typical, short-circuited power cable of the type described above is capable of generating heat at a temperature of about 90° F. to about 150° F. under a predetermined load (e.g. 20 to 30 kilowatts per foot of tubing). While some of this generated heat radiates into and through the wall of tubing to heat the fluid flowing through the tubing, a large portion of this heat is lost into the annulus of well. Typically it is preferred to keep the temperature of the heavy oil flowing through the tubing at a temperature above 50° F. (e.g. between about 50° F. and about 70° F.) to insure ready flow therethrough. Thus, it can be seen that the load on the cable has to be substantial since the heating efficiency from the externally-mounted cable is extremely low.

U.S. Pat. No. 8,224,164 takes the idea further, deploying temperature limited heaters down-hole for various uses, which can be a mineral insulated ("MI") cable. US20110017510 describes another MI heater cable, wherein the length of the cable is extended to reach further with electrical submersible pump (ESP) cable, which is much less expensive than MI cable.

Mineral-insulated copper-clad cable is a type of electrical cable made from copper conductors inside a copper sheath, insulated by inorganic magnesium oxide powder—the same type of heater used on older electric stove tops. The name is often abbreviated to MICC or MI cable, and colloquially known as "pyro" because the original manufacturer and vendor for this product was a company called Pyrotenax. A similar product sheathed with metals other than copper is called mineral insulated metal sheathed (MIMS) cable. By "MI cable" herein we mean to include both types.

MI cable is made by placing copper rods inside e.g., a circular copper tube and filling the intervening spaces with dry magnesium oxide powder. The overall assembly is then pressed between rollers to reduce its diameter (and increase its length). Up to seven conductors are often found in an MI cable, with up to 19 available from some manufacturers.

MI cable heaters have more optimum capabilities in various applications in the down-hole environment than polymer insulated heaters, i.e. higher temperature capability and higher power capabilities.

Further, since MI cables do not use organic material as insulation (except at the ends), they are more resistant to fires than plastic-insulated cables. MI cables are thus preferred in critical fire protection applications such as alarm circuits, fire pumps, and smoke control systems. MI cable is commonly used in industries that employ flammable fluids where small fires would otherwise cause damage to control or power cables. MI cable is also highly resistant to ionizing radiation and so finds applications in instrumentation for nuclear reactors and nuclear physics apparatus.

Because of its fire resistance, MI cable is particularly well suited for use in down-hole heaters, where fire can be catastrophic. However, the deployment of MI cable presents significant challenges, particularly when deployed into horizontal wells, used for example in steam assisted gravity drainage or "SAGD", which are the most common well types in oil sand production.

In SAGD, typically two horizontal wells are placed deep in the pay—a producer well at the bottom of the pay, and an injector some 4-10 meters above and parallel to the producer. Steam is continuously injected into the injector, which forms a steam chamber. At the edges of the steam chamber, heat is transferred to the heavy oil, which melts, and the mobilized oil and condensed steam gravity drain to the producer.

An MI cable heater system was recently installed in a horizontal well on the North Slope of Alaska. Because much of the well was horizontal, gravity could not be used to deploy the cable along the horizontal portion. Instead, the MI cable was encapsulated in a length of coiled tubing prior to installation in the well, and this was then fed into the well, using the usual coiled tubing equipment and techniques.

In the oil and gas industries, "coiled tubing" refers to a very long metal pipe, normally 1" to 3.25" in diameter. It is used for interventions in oil and gas wells and sometimes as production tubing in depleted gas wells. The coiled tubing is a continuous length of steel or composite tubing that is flexible enough to be wound on a large reel for transportation. The coiled tubing unit is composed of a reel with the coiled tubing, an injector, control console, power supply and well-control stack. The coiled tubing is injected into the existing production string, unwound from the reel and inserted into the well.

Coiled tubing is chosen over conventional straight tubing because conventional tubing has to be screwed together. Additionally, coiled tubing does not require a workover rig. Because coiled tubing is inserted into the well while production is ongoing, it can be a cost-effective choice and can be used on high-pressure wells. Although a useful tool, coil tubing is a costly way of deploying down-hole tools, requiring additional personnel, space and equipment.

Further, CT conveyance has a limited reach. As the tube unspools, it passes through a gooseneck and chain-driven injector head that causes the continuous tubing to exceed its yield strength. This operation helps remove the residual curvature that the string developed while on the CT reel. However, the tubing still retains a small amount of curvature. This curvature, coupled with bends and deviations in the wellbore, puts the CT string in contact with the wellbore wall in many places, generating frictional resistance. As more and more tubing is pushed into the wellbore, the string wraps against the wall in a long helical loop, eventually resulting in "helical lockup," where the CT tubing cannot be further pushed into the well.

Thus, there remains further need to develop and optimize methods for deploying MI cable in efficient manner. Preferably the method would not require CT tubing and could be both easily deployed as well as removed.

SUMMARY OF THE DISCLOSURE

Installing a MI cable heating system in a horizontal well has previously been accomplished by above ground encapsulating the MI cable inside steel coiled tubing for deployment using a CT spool and associated equipment. While at least partially effective, this method is costly because the coiled tubing has to be procured and the MI cable inserted into the coiled tubing, which is an expensive operation. Generally, this procedure is done far from the field location and the cost of shipping the MI cable with the coiled tubing inside further contributes to expense due to the size and weight of the assembly. Furthermore, the equipment required to install the MI cable encapsulated in the coiled tubing is expensive to operate on a daily basis, requiring additional personnel.

This invention, by contrast, allows for the MI cable to be installed in a well without the need for the MI cable to be encapsulated in coiled tubing before deployment of the CT. Furthermore, although specifically designed with an MI cable in mind, the method can be applied to other cable systems being deployed down-hole.

The MI cable heater can be any existing or to be developed MI cable heater. PENTAIR, for example, sells the PETROTRACE MI® heater cable which operates up to 572° F. (300° C.), provides up to 656 W/m, and has an Alloy 825 sheath or jacket outside the magnesium oxide layer that provides durability and corrosion resistance for use on a wide range of down-hole applications that require high power and temperature.

PETROTRACE, also by PENTAIR offers series-resistance heating cables are used in flow assurance applications when circuit lengths exceed the ratings of conventional parallel-resistance heating cables and a single power source is needed. The MI cable heater consists of a cut to length, field terminated, three-phase (with wye splice) constant wattage heating cable, which allows for temperature maintenance to 122° F. (50° C.) and provides up to 41 W/m.

MCAAA LTD is a manufacturer of stainless steel sheathed, single core mineral insulated power and heating cables. This heater looks a lot like a standard mineral insulated (MI) cable heater, but there are two important differences: 1) The increased ability for the magnesium oxide (MgO) to withstand the higher voltage without electrical breakdown, thus permitting operation at 4,160 V, and 2) the ability to manufacture the cable in long lengths, up to 2,000 meters without splices, is beneficial as splices have been a problem in other designs, which increased the diameter at the splice by about a factor of three times. This has caused considerable deployment issues, sometimes necessitating a larger well diameter.

As yet another example, the PYROTENAX by PENTAIR is based on a single wire, magnesium oxide cable inside a seamless metal jacket (alloy 825). THERMON also offers single phase and three phase MI heater cables known as MIQ. HEAT TRACE LTD has a three-phase self-regulating MI cable heater.

The MI cable is installed in the well via a dedicated tubing string without the use of a coiled tubing unit, but with a lower cost pumping unit. Likewise, the cable can be removed from the well using a unit with a winch that can pull the cable out of the well in a quick and easy operation.

The cable demonstrated herein consists of the three leads. It is a three phase system of an MI heater cable being encapsulated in a flexible armored coating or wrapping. The coating or wrapping should withstand the effects of long term immersion in potentially corrosive or erosive fluids plus the effects of high temperatures and pressures. In one embodiment, the cable would be pumped down-hole using some fluid, e.g., oil, which may be corrosive over long term immersion. Likewise, the act of pumping the cable down-hole could cause erosive damage if not properly protected. A braided metal jacket would be suitable, and also imparts strength and durability to the cable. If desired, the metal jacket can be Teflon coated as well.

In order to install the MI bundle in the well, the end that is installed in the well first is attached to a device that will allow the use of fluid to pump the bundle into the MI cable tubing to the end of the horizontal section of the well. This device—herein called a pump-in device—could be a rubber cone, plug, or pig, which would be attached to the down-hole end of the cable and would be sized such that it would limit fluid bypass, but still allow the device to convey the cable to the end of the well. Thus, as fluid pressure builds up, it will push the device down the hole, pulling the cable with it. If too much pressure is applied, it typically slips past the flexible pump-in device, as the vanes are flexible enough to allow this. Such devices are known in the art, and can be used herein. However, a dedicated tool may be preferred that is specially designed for using with a given cable size and given tube.

Generally speaking, the heater line is deployed down inside a tubing, which can be a dedicated tubing, a coiled tube, and the like, or it can be sent down the well without a dedicated heater tubing therein. The pump-in device needs only be adjusted in size for whatever tubing is being used. Furthermore, for long cable lines, a plurality of cones can be deployed over the MI Cable, such that there are multiple cones pulling the cable along the tube.

Generally speaking, the pump-in device has a hollow tubular center into which an MI heater cable can be inserted, and one or more concentric vanes or flexible collars circumnavigating the hollow center, such that each vane meets the tubular into which it is deployed, thus catching much of the fluid and preventing its by pass. The vanes are angled (pointing down-hole) and sized such that they are slightly larger than the tubing, such that when fluid is applied to one side, the vanes lift, sealing off the tubing.

The pump-in device usually has a hollow tubular or cylindrical center, into which the MI cable can be friction fitted or otherwise attached. The conical vanes circumnavigate the central core, and at least some are angled such that fluid behind the vanes presses the vanes tighter against the walls of the tubing, thus preventing most if not all fluid from bypassing the cone. The device can also have vanes that are not so angled, but perpendicular to the core, but this is optional, and a cone with all vanes angled may be preferred.

Once the MI bundle is fully inserted into the lateral section of the well, the device will operate a bypass area or a rupturable diaphragm (similar to a cementing wiper plug), such that an indication will be received at surface that the bundle is fully inserted into the well. A rupture plug is often included in wiper plug, such that the diaphragm in the plug body ruptures under 250~400 psi easily to allow the cement slurry to pass through after the plug reaches the landing collar. The top plug has a solid body that provides positive indication of contact with the landing collar and bottom plug through an increase in pump pressure.

The MI bundle is attached to the pump-in device with a weak link, such that when the MI bundle is removed from the well, the weak link will easily part to allow easy remove of the MI bundle by winching the cable out of the well. This contingency-release device is designed to break before the cable does.

This "weak link" or "breakaway connector" can be a traditional mechanical device, designed to provide release at a certain load, usually much less than the breakage point of the down-hole cable. See e.g., U.S. Pat. No. 4,697,641. However, if the well is particularly long or deep, an electrically controlled release device (ECRD) can be used to replace the mechanical weakpoint in the tool head. With this device, tension at the tool head can reach 8,000 lbf [35.6 kN], which is the load limitation of the ECRD. Until it is activated, an ECRD weakpoint can withstand high cable-tension pulls and large shocks. Such ECRD units are commercially available from a variety of service companies including Schlumberger, Baker Hughes, Halliburton, Weatherford, NOV and the like. ECRD weakpoints are rated to operate up to 400° F. [204° C.] and 20,000 psi [138 MPa]. There is also a version capable of operating to 500° F. [260° C.] and 30,000 psi [207 MPa].

This invention allows deployment of MI heater cable into a well in a low cost and efficient manner. The equipment used is minimal and requires a limited number of workers to operate. Likewise, removing the MI heater cable from the well is a quick and efficient operation.

This method avoids having to remove the entire production tubing with the pump attached in the event the MI cable heater fails or there is a desire to replace it with a MI cable heater with different characteristics.

This method avoids the expense of the coiled tubing encapsulation previously described and also avoids the time and expense of utilizing a service coiled tubing unit to deploy and remove the MI heater cable. However, if CT coil is already in place, it can be used as dedicated tubing inside which the MI cable heater is deployed.

The invention includes the following one or more embodiments, in any combination thereof:

A method of deploying a mineral insulated (MI) cable heater down-hole, said comprising:

providing an MI cable heater;

attaching a pump-in device to a down-hole end of said MI cable heater via a breakaway connection or connector;

feeding said MI cable heater and pump-in device into a down-hole tubing;

pumping an injection fluid into said down-hole tubing at a first pressure, said first pressure being sufficient to drive said pump-in device and attached MI cable heater down-hole;

detecting when said MI cable heater is fully deployed; and ceasing said pumping step d.

A method of producing heavy oil, said comprising:

providing an MI cable heater having a breakaway connector operably coupled to a pump-in device at a down-hole end of said MI cable heater;

feeding said MI cable heater and pump-in device into a down-hole tubing in a reservoir;

pumping an injection fluid into said down-hole tubing at a first pressure, said first pressure being sufficient to drive said pump-in device and attached MI cable heater down-hole into said reservoir;

detecting when said MI cable heater is fully deployed;

ceasing said pumping step d;

heating heavy oil with said MI cable heater until it becomes mobilized; and producing said mobilized heavy oil.

A heated well system comprising a down-hole heater comprising a mineral insulated cable that is hung off or suspended in a wellhead such that it can be left in the well during production operations, but which allows the cable to be electrically connected to a surface control panel and transformer into order to power the device.

A heated well system comprising a down-hole heater comprising a MI cable deployed inside a dedicated tubing inside a production well or an injection well, said MI cable is hung off a wellhead and left in said well during production operations, said MI cable electrically connected to a surface control panel and transformer into order to power the MI said MI cable and connected at a down-hole end via a breakaway connector to a pump-in device.

A down-hole heater, comprising a mineral insulated cable having three resistor elements, each resister element inside a mineral insulated jacket, all three resistor elements being contained inside a support jacket that is resistant to corrosion by crude petroleum, said down-hole heater having a down-hole end, and said down-hole end comprising a breakaway connector coupled to a pump-in-device.

Any method or heater or system herein described, wherein said MI cable is retrieved by disconnecting said breakaway connection and winching said MI cable heater back up out of said down-hole tubing.

Any method or heater or system herein described, wherein said breakaway connection is activated by applying an electrical signal.

Any method or heater or system herein described, wherein said breakaway connection is activated by exceeding a breakway force.

Any method or heater or system herein described, wherein said pump-in device has a hollow cylindrical core into which said MI cable heater is fitted, and a plurality of vanes circumnavigating said core such that fluid pressure behind said pump-in device pushes said plurality of vanes against an interior wall of said down-hole tubing.

Any method or heater or system herein described, wherein said vanes comprise reinforced rubber or comprise rubber sheathed with polytetrafluoroethylene.

Any method or heater or system herein described, wherein said pump-in device comprise reinforced rubber or comprise rubber sheathed with polytetrafluoroethylene.

Any heater or system or method as herein described, wherein said support jacket for a MI cable heater is braided metal.

Any heater or system or method as herein described, wherein said a second protective coating on a heater cable or vane or pump-in device comprises polytetrafluoroethylene.

As used herein a "pump-in device" is one that allows a cable to be deployed down-hole using fluid pressure. Hence it contains attachment means for the cable or a mandrel for same, as well as a flexible means for sealing the tube, such that fluid can push the pump-in device further down-hole. Preferably, the flexible means for sealing the tube are a plurality of angled vanes.

As used herein a "vane" is a flexible annular protrusion or collar on a tubular device. Thus, the vane circumnavigates the tube.

As used herein an "angled vane" is a vane set at less than 90° from the main axis of the pump-in device, the smaller angle being on the higher pressure side, such that the vanes point downhole. Fluid pressure will press the vanes against the pipe, thus sealing it and allowing pressure to drive the pump-in device downhole.

As used herein, "flexible" means enough flex at typically downhole pumping pressures to allow the vane to move in response to that pressure and be pressed against the tubing in which it is housed. "Very flexible" means that the vane has enough flex that it can be inverted, so as to drag the pump-in device out. Most vanes are flexible, and some are very flexible.

As used herein an "MI cable heater" has resistor wires encapsulated in a mineral insulator, such as magnesium oxide, and typically inside a metal sheath, such as copper, stainless steel, or alloy 825. The wire can be copper, nickel chromium, nickel iron, and the like, and the cables can have additional protective coatings or jackets for strength. MI heater cable can be connected to other cable types outside of the heater section.

As used herein a "breakaway connector" is a connector that will release under known prescribed conditions, such as high pressure or weight, an electrical signal, and the like, thus allowing the directed separation of two components while down-hole at a specified signal from the operator.

The use of the word "a" or "an" when used in conjunction with the term "comprising" in the claims or the specification means one or more than one, unless the context dictates otherwise.

The term "about" means the stated value plus or minus the margin of error of measurement or plus or minus 10% if no method of measurement is indicated.

The use of the term "or" in the claims is used to mean "and/or" unless explicitly indicated to refer to alternatives only or if the alternatives are mutually exclusive.

The terms "comprise", "have", "include" and "contain" (and their variants) are open-ended linking verbs and allow the addition of other elements when used in a claim.

The phrase "consisting of" is closed, and excludes all additional elements.

The phrase "consisting essentially of" excludes additional material elements, but allows the inclusions of non-material elements that do not substantially change the nature of the invention, such as instructions for use, buffers, salts, and the like.

The following abbreviations are used herein:

| ABBREVIATION | TERM |
|---|---|
| CT | Coiled tubing |
| ESP | Electric Submersible pump |
| MI | Mineral Insulated |
| MICC | Mineral Insulated Copper Clad |
| MIMS | Mineral Insulated Metal Sheathed |
| SAGD | Steam assisted gravity drainage |

BRIEF DESCRIPTION OF THE DRAWINGS

FIG. 7A-E. MI heater cable layouts.

DETAILED DESCRIPTION

The disclosure provides a novel method of deploying an MI Cable heater down-hole that avoids the complex and expensive method using CT encapsulation, or difficult deployments to the outside of e.g., a stinger tube.

SPE-167347 (2013) by Parman, for example, teaches a heater that consists of a multi-stage, 3 cable MI heater in the pay zone, powered via ESP cable (see petrowiki.org/ESP-_power_cable). The MI heater was constructed to provide highest power output (and heat) near the toe, somewhat less power in the middle section of the lateral, and less still near the heel. A "cold lead" section was also included to ensure that the ESP cable and connection components do not overheat. This three-cable system was deployed down-hole, attached to the outside of a stinger pipe in the horizontal section of pipe. Deployment details are not provided, but clearly deploying three cables down a significant length of horizontal pipe is not trivial. The invention herein described teaches how to avoid such difficult deployment issues.

Figure 1A:
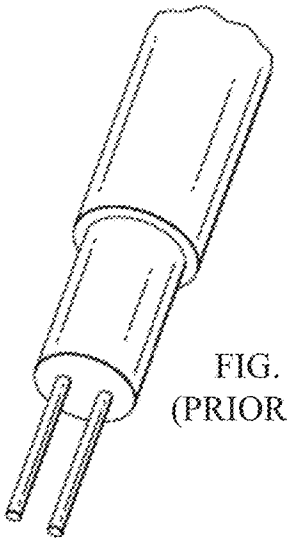
FIG. 1A (PRIOR ART)
FIG. 1A depicts an MI cable having two conductor cables.
Figure 1B:
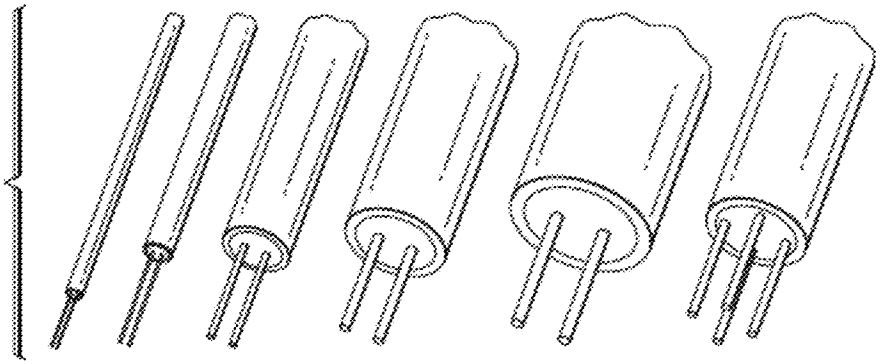
FIG. 1B (PRIOR ART)
FIG. 1B depicts an MI cable with various numbers of conducting cables.

FIG. 1A shows that basic structure of an MI cable, in this case a 2 wire cable with two copper wires inside a copper tubing, covered with $MgO_2$ coating, and herein with an exterior sheath of jacket on Alloy 825. However, MI cable is available in a large number of sizes and configures, see e.g., FIG. 1B, and can have various exterior jackets according to the application needs. To make a heater from this cable, a closed circuit is created. Temperature may be controlled by a thermocouple or by changing the voltage delivered to the system. In one embodiment a closed loop cap is placed on the MI cable to close two of the insulated cables.

Figure 2:
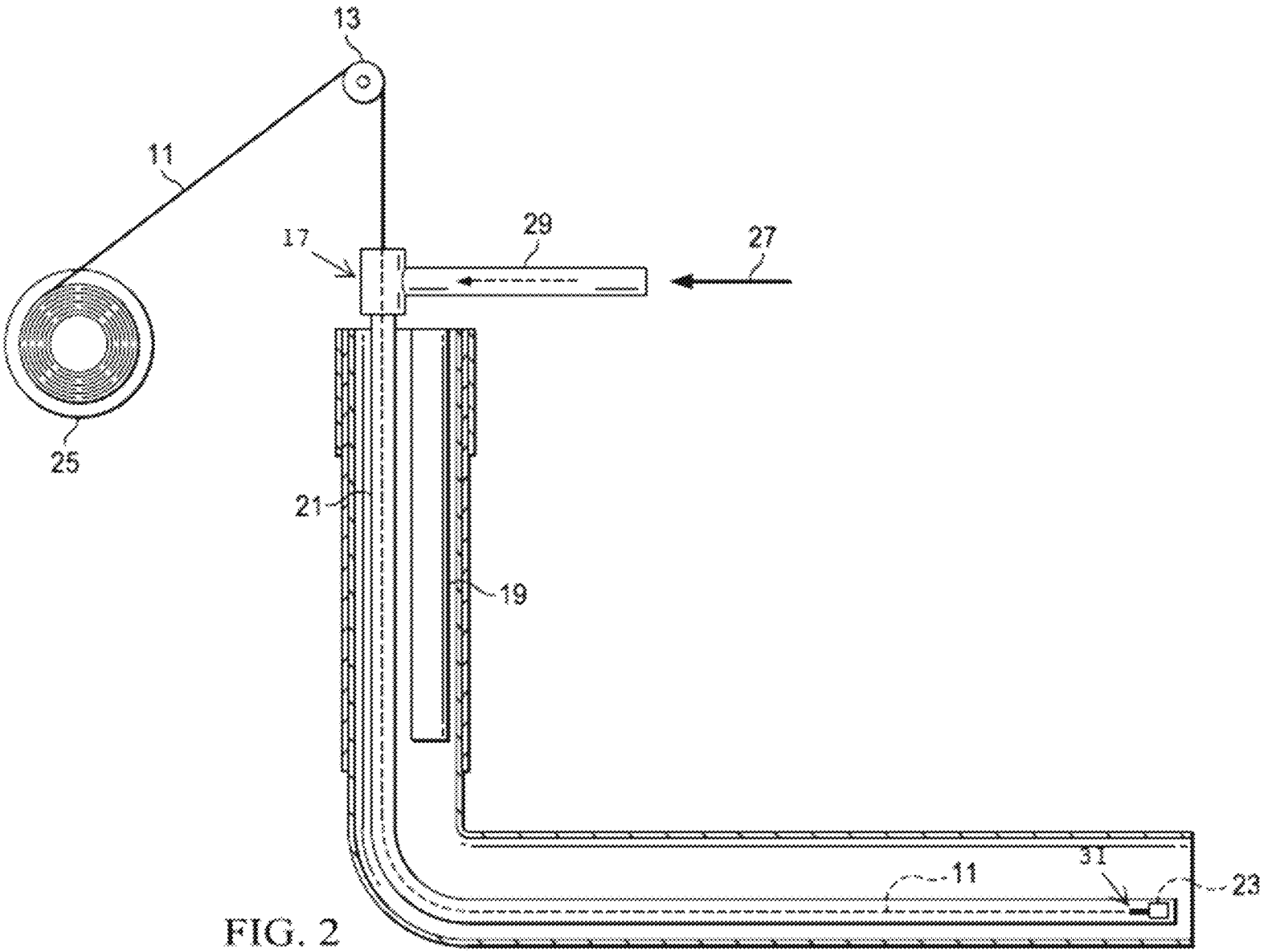
FIG. 2. Schematic of MI cable deployment system.
Figure 6:
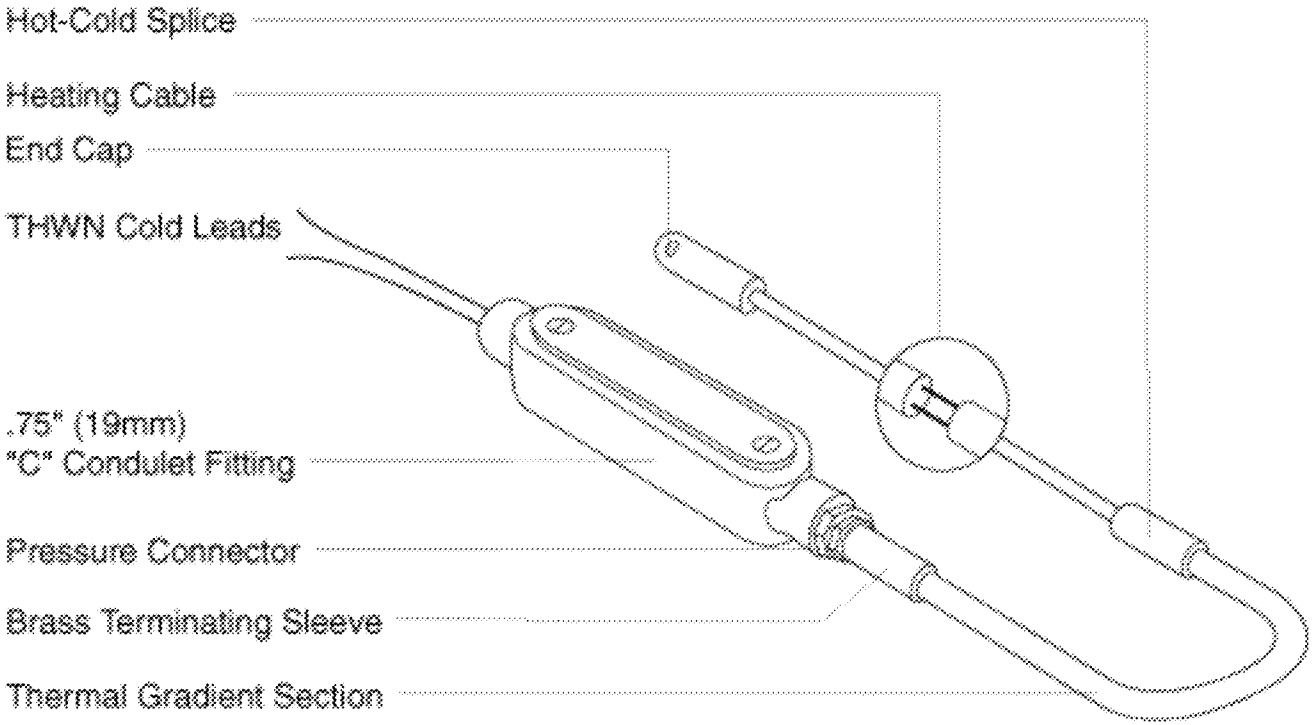
FIG. 6 (PRIOR ART)
FIG. 6. MI heater cable.

FIG. 2 shows one exemplary deployment method of the invention in a well casing 19, wherein MI cable bundle 11 is provided on a reel 25. The details of the MI heater cable are not seen in this figure, but heaters are known in the art and exemplary layouts are shown in FIGS. 6-7. Instead, this figure demonstrates the overall deployment of such a cable down-hole. The MI cable 11 passes through pulley 13, down through flow tee or flow head 17, and injection fluid 27 feeds in through injection fluid line 29. Flow tee or flow head 17 has packing or other sealer on the top to seal off against the cable such that the fluid would be forced down-hole, yet cable entry is permitted. The cable 11 passes through cable-tubing 21 down hole to the point where it is needed, and the conveyance is by pump-in device or swab cup 23 at the end of the cable, which works by pushing the cable down hole under fluid pressure. The cup 23 essentially seals the fluid, driving the cable plus fluid down hole.

Weak line or a breakaway connector 31 (32-35 in FIG. 3B) is provided between the pump-in device 23 and the cable 11. Thus, on return, sufficient force (or an electrical signal) is provided to disconnect the cable, and the cable can be retracted with a winch (not shown), attached to pulley 13.

Pump-in device 23 is a conical plug, analogous to a wiper plug used in cementing operations or a swab cup for swabbing a well. A specific pump-in device can be provided per FIG. 3A. However, a special device is not necessary, as there are commercial devices available in a range of styles and sizes that can be used herein for this purposes. FIG. 3B shows swab cup styles that are already commercially available.

Figure 3A:
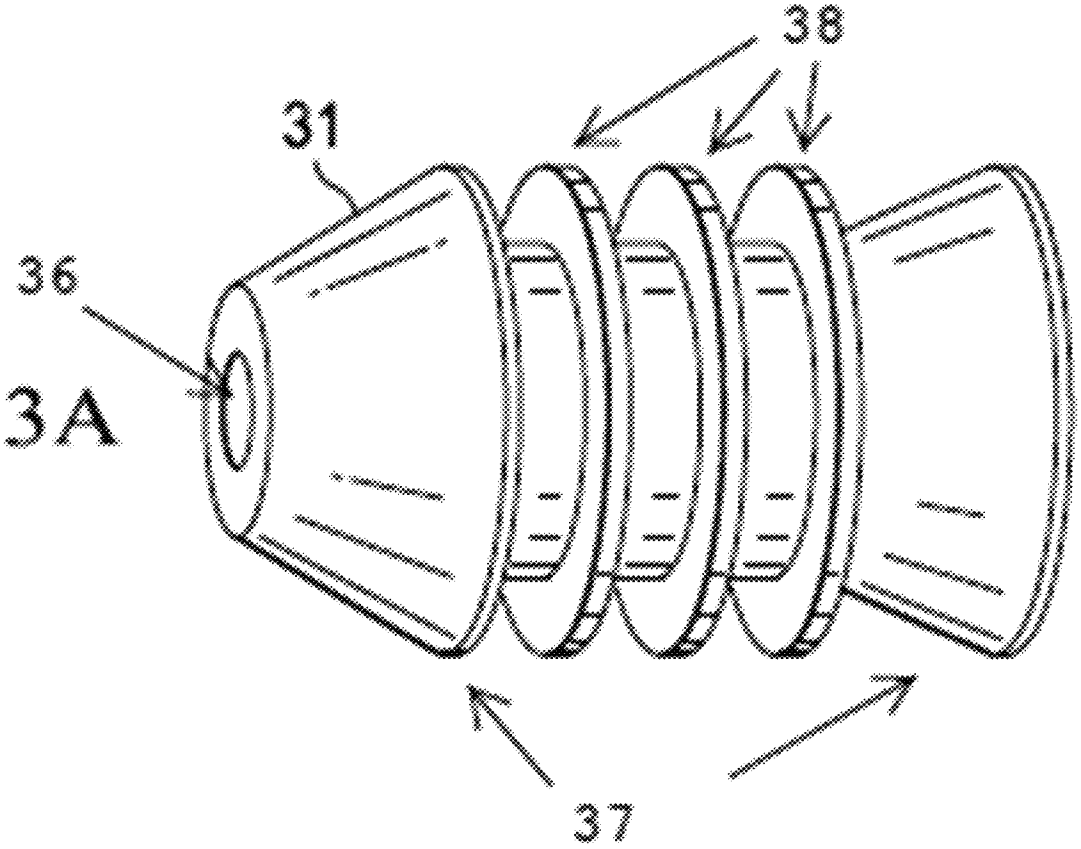
FIG. 3A-B. Exemplary pump-in devices. A device can be designed specifically for this job (3A), or existing devices (3B) can be repurposed for use as pump-in devices. See also FIG. 5.
Figure 3B:
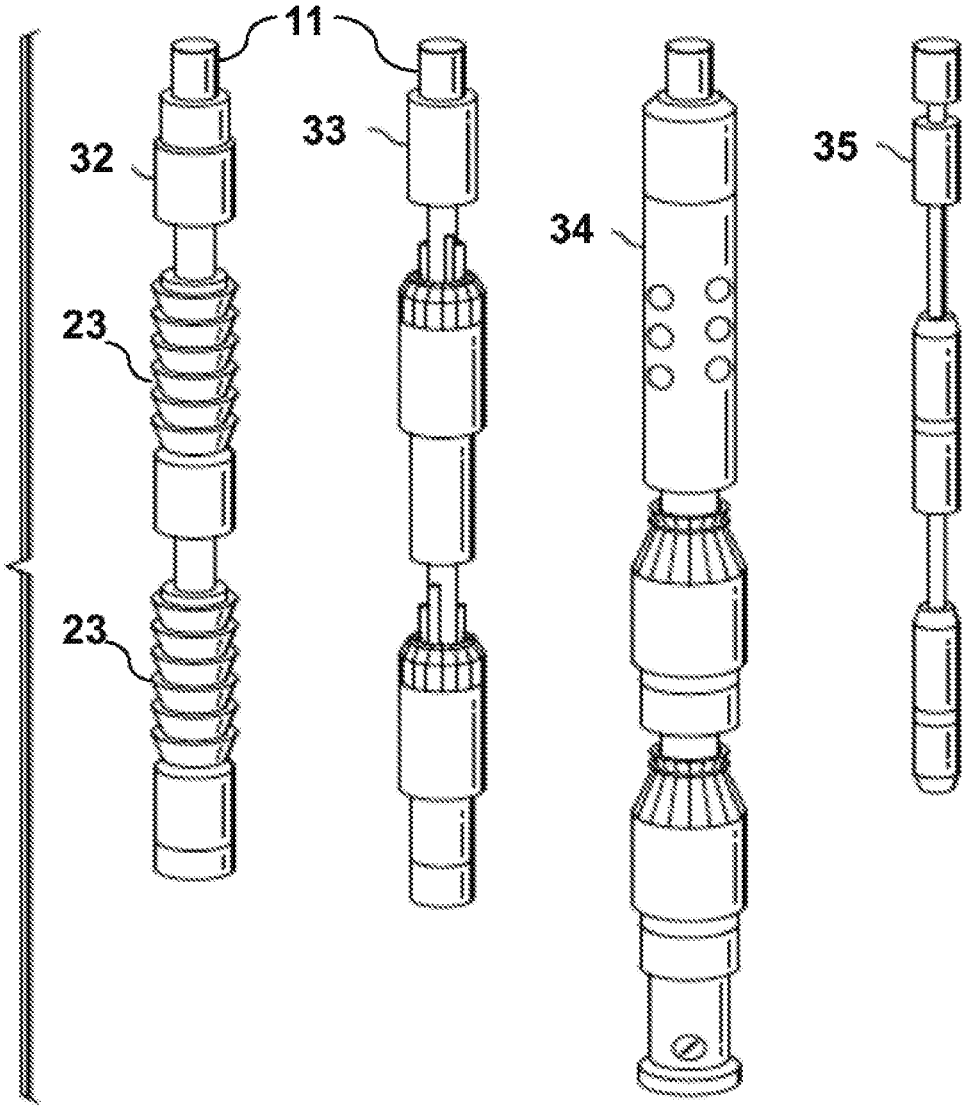
FIG. 3B (Prior Art)

FIG. 3A shows a cup 31 having a central hole or tunnel 36 into which the cable can be frictionally fit, or screws can be provided to tighten the cable into the device. Sealing vanes 37 are angled such that they point towards the down-hole end, such that flow pushes the vane harder against the tubing, sealing off the wellbore fluid, thus building up pressure on the cable side of the cup (right in this figure), and pushing the cup with cable further down-hole. Additional vanes 38, herein arranged perpendicularly to the axis, can provide additional pressure points.

Any number of such pump-in devices can be fitted to the cable, thus providing a quick easy method of deployment of cables down-hole, however a single pump-in device may be preferred, since the breakaway connector is up-hole of these devices. Alternatively, a very flexible swab cup can be used that can be pulled backwards out of the hole can be used if the vanes are flexible enough to allow this. In such case, a plurality of pump-in devices may be better suited.

We initiated a project to install a down-hole mineral insulated (MI) heater into a test well. The objectives were to establish production without the need to inject diesel, previously required to achieve production on the North slope, in order to obtain a large volume uncontaminated sample of the $9^0$ API crude and to test the viability of using a down-hole heater to produce the reservoir in areas that are not applicable to Steam Assisted Gravity Drainage (SAGD) production due to limited net reservoir thickness.

The challenge faced in executing the project was to install a heater in the well without the use of a workover rig to deploy the coiled tubing. Only by using typical well servicing equipment available at the well and by tailoring the solution to the existing well would the cost of the experimental project render it viable. The solution required us to design, engineer, and fabricate a heater assembly and purpose-built well head-hanger assembly to accomplish the job.

Three MI heater leads plus braided support cable were installed into a spool of 1¾" coiled tubing such that when run into the well to the toe of the lateral through an existing tubing string, only a short section would need to be cut before being hung off. The specialized hanger was installed onto the tree and allowed the coiled tubing to be hung off and provide for a pressure tight penetration to be made for the electrical connections. Although we envision deployment without coiled tubing, the extra tubing string was already deployed in our test well, and we took advantage of the existing layout. Importantly, the tubing did not need to be retracted and fitted with an MI Cable. Instead, the MI cable was sent down the already deployed tubing encapsulated in a string of coiled tubing The MI cable used on the test well had three wires. The three-phase heater was used in order to impart sufficient heat down-hole in an Alaskan environment (watt density of 50-250 W/Ft, preferably >150 or >200 W/ft), but one or two lead heaters might also suffice in reservoirs with less viscous crude.

This method envisions encapsulating multiple wires into a single bundle with a common sheathing, but the three separate cables sufficed for proof of concept. It is noted, that multi-wire MI cables are available (e.g., from M.I. Cable Company or "MICC") wherein the conductive leads are embedded in a highly dielectric magnesium oxide insulation surrounded by a metal sheath of Alloy 825. Wire can be e.g., a nickel-chrome iron with resistivity of 620 ohms-cmf at 68°

F. (20° C.), or high conductivity copper ASTM B4 or B5, or solid nickel, or nickel iron, and the like.

Heater cable needs to be twice the pipe length, and thus each heater cable is factory fabricated for a specific length of a certain size pipe. It is important to install MI cable so that minimal bending occurs. Cable will work harden and break if repeatedly re-bent. It is also sometimes recommended that MI heater cable not be bent to an inside radius of less than five or six times the cable's diameter.

Figure 4:
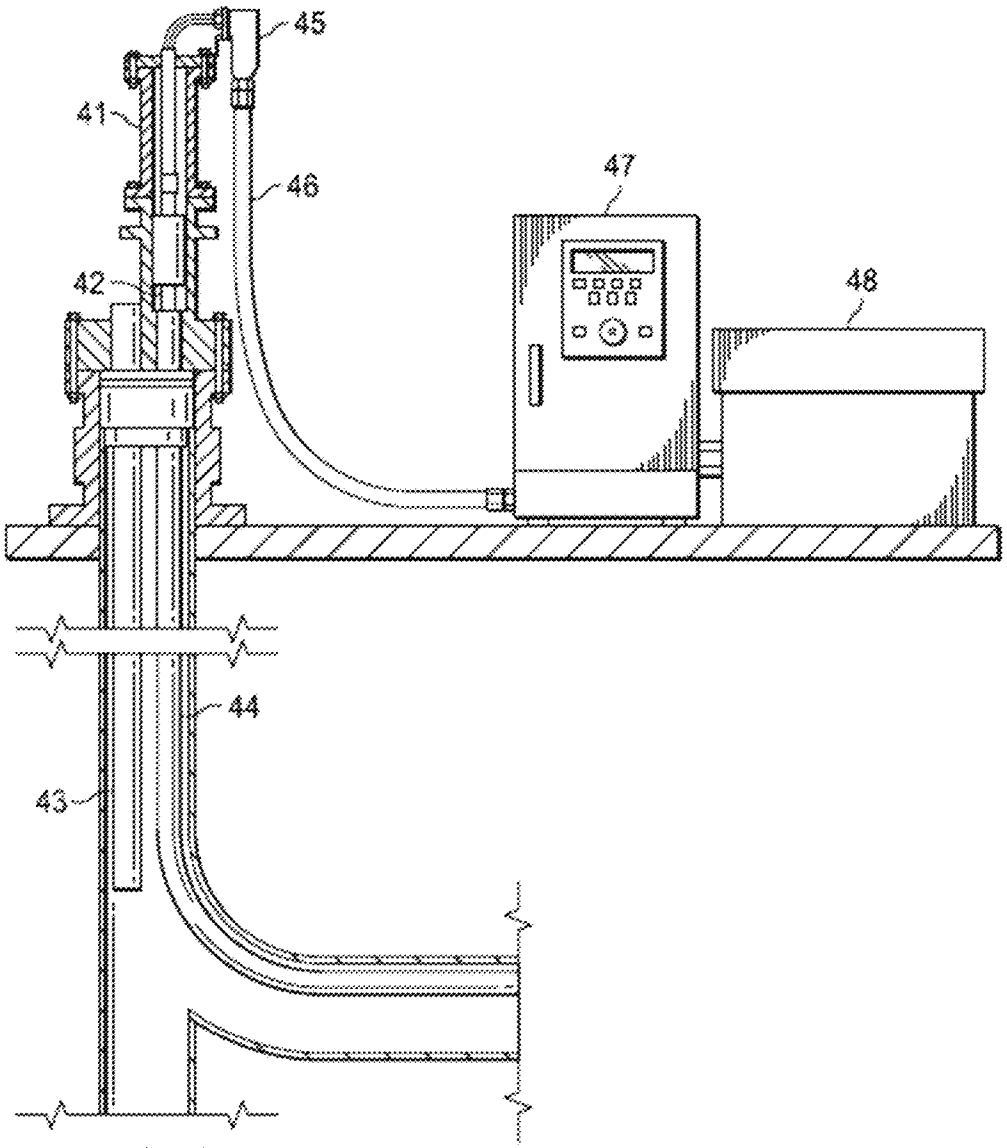
FIG. 4. Exemplary deployment of the system.
Figure 5:
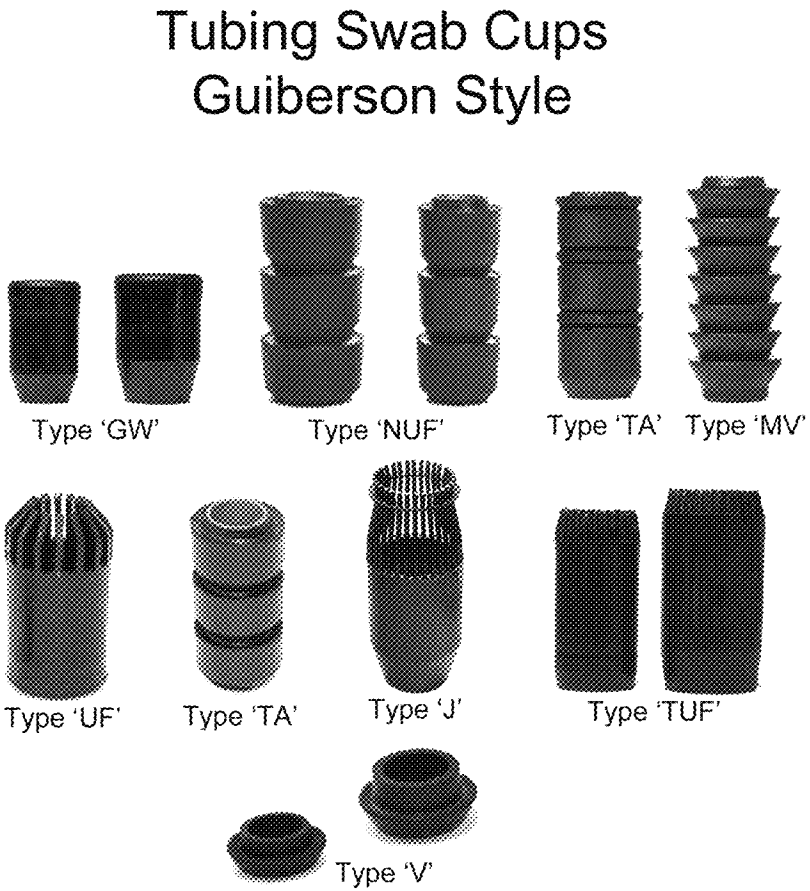
FIG. 5 (PRIOR ART)
FIG. 5. Swab cups.

FIG. 4 shows the cable heater deployment. The heater is not in the production tubing 43, but through an adjacent tubing string. The MI cable 42 is deployed inside a dedicated tubing string 44, herein a string of coiled tubing. The CT termination spool 41 is modified to permit the power cable to exit the wellhead and allow fluid to be pumped into the tubing for pressure testing purposes. The MI cable is connected at the surface via connector 45 and surface cable 46 to a heater control panel 47 and transformer 48.

An installation as shown in FIG. 4 was accomplished using an MI cable encapsulated in 1¾" coiled tubing deployed from a typical CT service unit, resulting in a virtually flawless deployment. The final electrical and instrumentation hookup and commissioning was done and the heater was powered up on a low heat setting. The heater was turned to its high setting a day later, and two days later, the well's progressive cavity electrical submersible pump (not shown) was started. The well immediately began surfacing fluids and established a rate of 70 BOPD with a 20-25% water cut. The temperature at the pump inlet increased from the static temperature of 65° F. to 195° F., which lowered the viscosity of the oil from its in situ value of 20,000 centipoise to 100 centipoise and allowed the well to produce.

The first objective of the project was accomplished when ten 55 gallon drums of uncontaminated North slope crude were collected and shipped to the lab for analysis. After sampling was complete, the pump speed was increased from 32 hertz to 50 hertz over a few months duration while the well rate increased from 70 BOPD to over 100 BOPD.

The well continues to produce at a water cut of 20% with little to no sand production. This is the most heavy oil ever produced from our North Slope acreage and the first time a down-hole heater has been utilized in an Alaskan oil field. This project has successfully demonstrated that heavy oil can be produced under primary production with down-hole heaters and has the potential to unlock up to one 100 MMBO of net resource from the oil sands. Further, the use of a pump-in device and releasable connecter allow much easier deployment and retrieval, contributing significantly to cost savings.

FIG. 6 shows a basic heater layout. The heater is comprised of three components: 1) A central conductor of an electrically resistive metal, 2) surrounded by a highly compressed mineral insulant (MgO), and 3) sheathed with a metal covering of copper or stainless steel. The metal sheathing provides a permanent ground to comply with NEC 427.23.

Copper sheathed cables are used for general environments where corrosion and high temperatures will not be present. The cables should not be used above a working temperature of 300° F. or where an exposure temperature of more than 400° F. is required. Nickel Chrome alloy cables, in contrast, are able to withstand 1250° F. energized and can maintain temperatures up to 800° F. The base sheath is unaffected by a wide range of aggressive alkalis and acids, thus making the cable ideal for projects in chemical plants, refineries, utilities, etc. Stainless steel sheathing is also available, e.g., from MCAAA.

Using single or three phase power supplies and carefully selecting the correct cable can make heating circuits for to 600 volts from most suppliers, and up to 4160 volts if MCAA cable is used. The higher voltage cable is preferred as more efficient per the following table, excerpted from SPE-170146-MS:

| Cable Voltage | 600 Volt | 4160 Volt |
|---|---|---|
| Power per foot | 144 watts per foot | 140 watts per foot |
| Operating Tem*erature | 400° C. | 400° C. |
| Length of heated section | 250 feet | 2000 feet |
| Outside design diameter of MI cable | 1.00 inch | 0.75 inch |
| Diameter of heater wire in MI | 0.25 inch | 0.155 inch |
| Diameter of Overburden wire in MI | 0.25 inch | 0.155 inch |
| Overburden Loss as % of Total | 51.9% | 11.8% |
| Estimated weight of 3 cables/foot | 5.3 lbs/ft. | 3.0 lbs/ft |
| Overburden length | 2000 Feet | 2000 feet |

FIG. 7A-E shows various heater layouts commercially available from Thermon MIQ. These cable sets are available in four factory fabricated configurations: Type A, B, D or E. Other designs are available from other suppliers, e.g., Korea EHT (KR), Economy Engineering Corp. (IN), HotFoil EHS (NJ).

The standard assemblies consist of a predetermined length of heating cable joined to a standard 1.2 m or 2.1 m non-heating cold lead with 305 mm long thermoplastic insulated pigtails. The non-heating section of the unit is sealed and fitted with a high pressure, liquid-tight M20, M25 or M32 brass gland 3 for connection into the supply junction box. ESP cable is preferred for the cold lead uses described herein, and any suitable connectors can be used.

As described herein, the MI cable may be pumped in using a scab cup with fluid pressure for deployment. In one embodiment the plug is releasably attached to the cable such that when the MI cable has been deployed and reached its desired depth, the pressure is increased and the plug breaks away from the MI cable. In another embodiment a dissolvable plug is used such that once the MI cable has been deployed and reached its desired depth, the plug dissolves preventing the plug from interfering with subsequent production.

Alternatively, a down-hole tractor can be used, and this may be preferred for particularly long wells. A tractor can be placed to either push or pull a toolstring, but the toolstring is short in comparison to the cable connecting the tractor and toolstring to surface. Putting the motive force near the front of the conveyance string enables it to move tools and devices along extended horizontal sections. Even in locations where wellbore deviation exceeds 90°, the tractor pushes the toolstring uphill.

Such down-hole tractors are commercially available. e.g., from Schlumberger, Kodiak, Baker Hughes, Halliburton, Weatherford, NOV and other providers. For example, Schlumberger offers the MaxTRAC® down-hole tractor system, which is a reciprocating-grip down-hole tractor that delivers more than 40% efficiency. GE Energy also has a Modular Down-hole Tractor (MDT).

MI cable may be deployed in any situation where low temperature can interfere with production. In one embodiment, MI cable is deployed to maintain fluidity in a heavy oil reservoir. In another embodiment, MI cable may be deployed in a cold weather environment where cooling or freezing may be an issue. In yet another embodiment, MI cable may be deployed where hydrate inhibitors may not be sufficient to keep hydrates from forming. The ability to drive or push the MI cable inexpensively to any location within the well, will provide many new and unique opportunities to use MI cable.

The following references are incorporated by reference in their entirety for all purposes.

SPE-170146-MS: Sandberg et al., Advances in Electrical Heating Technology for Heavy Oil Production, available online at mcaaa.eu/resources/Advances-in-Electrical-Heating-Technology-for-Heavy-OilProduction.pdf SPE-167347 (2013) Parman D. et al., Use of Electric Down-hole Heaters to Improve Production and Recovery of Heavy, Viscous Oil in California and Venezuela.

U.S. Pat. No. 5,871,052: Apparatus and method for down-hole tool deployment with mud pumping techniques.

The present invention is exemplified with respect to MI cable heaters. However, this is exemplary only, and the invention can be broadly applied to any heater cable, or indeed any cable. Any examples herein are intended to be illustrative only, and not unduly limit the scope of the appended claims. Any detail herein provided is intended to be combinable with any other detail also mentioned here, whether in the same paragraph or not, and whether or not discussed as relates to the prior art or the invention, because providing separate paragraphs for each possible combination would be unduly lengthy and repetitive.

What is claimed is:

1. A method of deploying a mineral insulated (MI) cable heater down-hole in a horizontal well, said method comprising:

a) providing an MI cable heater;

b) attaching a plurality of pump-in devices to a down-hole end of said MI cable heater and along a length of said MI cable heater via a breakaway connector, each pump-in device comprising a cone having a hollow cylindrical core sized for insertion of said MI cable heater therethrough and a plurality of angled vanes circumnavigating said core such that fluid pressure behind said pump-in device pushes said vanes against an interior wall of a down-hole tubing;

c) feeding said MI cable heater and pump-in devices into a dedicated tubing for said MI cable in a horizontal well comprising a production tubing without removing said production tubing from said horizontal well and such that said MI cable heater is not inside said production tubing and the dedicated tubing is non-concentric with the production tubing and both tubings extend into the well from the surface;

d) pumping an injection fluid into said dedicated tubing at a first pressure, said first pressure being sufficient to drive said pump-in device and attached MI cable heater down-hole into said dedicated tubing in said horizontal well;

e) detecting when said MI cable heater is fully deployed; and f) ceasing said pumping step (d).

2. The method of claim 1, wherein said MI cable is retrieved by disconnecting the breakaway connector and winching said MI cable heater back up and out of said dedicated tubing without removing said production tubing.

3. The method of claim 2, wherein said breakaway connector is activated by applying an electrical signal.

4. The method of claim 2, wherein said breakaway connector is activated by exceeding a breakway force.

5. The method of claim 1, wherein each said pump-in device is a dissolvable pump-in device.

6. The method of claim 1, wherein said MI heater cable has one or more MI cables inside a single protective jacket.

7. A method of producing heavy oil, said method comprising:

a) providing a mineral insulated (MI) cable heater operably coupled to a pump-in device at a down-hole end of said MI cable heater via a breakaway connector;

b) feeding said MI cable heater and said pump-in devices into an inside of a dedicated tubing for said MI cable in a horizontal well comprising a production tubing such that said MI cable heater is not inside said production tubing and without removing said production tubing from said horizontal well, and the dedicated tubing is non-concentric with the production tubing and both tubings extend into the well from the surface;

c) pumping an injection fluid into said dedicated tubing at a first pressure, said first pressure being sufficient to drive said pump-in devices and MI cable heater down-hole into said dedicated tubing in said horizontal well;

d) detecting when said MI cable heater is fully deployed;

e) ceasing said pumping step c;

f) heating heavy oil with said MI cable heater until it becomes mobilized heavy oil; and g) producing said mobilized heavy oil.

8. The method of claim 7, wherein said MI cable heater is retrieved by disconnecting said breakaway connector and winching said MI cable heater out of said dedicated tubing without removing said production tubing.

9. The method of claim 8, wherein said breakaway connector is activated by applying an electrical signal.

10. The method of claim 8, wherein said breakaway connector is activated by exceeding a breakway force.

11. The method of claim 7, wherein each said pump-in device is a dissolvable pump-in device.

12. The method of claim 7, wherein each said pump-in device has a hollow cylindrical core into which said MI cable heater is fitted, and a plurality of angled vanes circumnavigating said core such that fluid pressure behind said pump-in device pushes said vanes against an interior wall of said dedicated tubing.

13. The method of claim 12, wherein said vanes comprise reinforced rubber.

14. The method of claim 12, wherein said vanes comprise rubber sheathed with polytetrafluoroethylene.

15. The method of claim 12, wherein said pump-in devices comprise reinforced rubber.

16. The method of claim 12, wherein said pump-in devices comprise rubber sheathed with polytetrafluoroethylene.

* * * * *